US011482386B1

(12) United States Patent
Rudd

(10) Patent No.: US 11,482,386 B1
(45) Date of Patent: Oct. 25, 2022

(54) WALL SWITCH LOCKOUT

(71) Applicant: Brady Worldwide, Inc., Milwaukee, WI (US)

(72) Inventor: Gregory Rudd, Milwaukee, WI (US)

(73) Assignee: Brady Worldwide, Inc., Milwaukee, WI (US)

( * ) Notice: Subject to any disclaimer, the term of this patent is extended or adjusted under 35 U.S.C. 154(b) by 0 days.

(21) Appl. No.: 17/362,679

(22) Filed: Jun. 29, 2021

(51) Int. Cl.
*H01H 9/28* (2006.01)

(52) U.S. Cl.
CPC ..... *H01H 9/287* (2013.01)

(58) Field of Classification Search
CPC ..... H01H 9/287; H01H 9/20; H01H 9/00
USPC ..... 200/43.22, 43.01, 43.14, 43.15, 43.16, 200/522
See application file for complete search history.

(56) References Cited

U.S. PATENT DOCUMENTS 5,543,593 A 8/1996 Turek
5,558,209 A * 9/1996 Mohsen ..... H01H 9/283 200/43.11
5,738,206 A * 4/1998 Souza ..... H01H 3/20 200/322
2006/0278504 A1 12/2006 Brojanac
2014/0262710 A1 9/2014 Rego et al.

* cited by examiner

*Primary Examiner* — Edwin A. Leon
*Assistant Examiner* — Iman Malakooti
(74) *Attorney, Agent, or Firm* — Quarles & Brady LLP

(57) ABSTRACT

A wall switch lockout device for selectively limiting access to a wall switch relative to which the wall switch lockout device is mounted. The wall switch lockout device includes a mountable base having a switch opening extending therethrough for receiving the wall switch, a cover positionable and securable over a front face of the mountable base for selectively covering and limiting access to the switch opening, and one or more inserts received in the mountable base and slidable relative thereto. The wall switch lockout device further has a pair of mounting openings for mounting the mountable base and at least one of the pair of mounting openings is on the one or more inserts such that, when the one or more inserts are slid relative to the mountable base, a hole-to-hole distance between the pair of mounting openings is variably adjusted.

16 Claims, 7 Drawing Sheets

WALL SWITCH LOCKOUT

CROSS-REFERENCE TO RELATED APPLICATION

Not applicable.

STATEMENT OF FEDERALLY SPONSORED RESEARCH OR DEVELOPMENT

Not applicable.

BACKGROUND

This application relates to a lockout device for locking out a wall switch.

Lockout devices are conventionally used as a mechanism to limit operation of a control or energy isolation point. Such lockout devices can be used on switches, plugs, valves, and so forth in order to prevent operation of that control or energy isolation point under certain circumstances or by certain users. In many instances, for example, when maintenance is being performed on equipment by a worker, a control may be turned off to de-energize the equipment (for example, to temporarily cut power from the equipment) and a lockout device may be placed over the control by the worker in order to prevent others from operating the control to re-energize the equipment until the worker has completed the maintenance and removed the lockout device.

However, the example above is exemplary only and there are many use cases and many types of controls that might receive a lockout device for a variety of reasons, some of which having nothing to do with maintenance at all. For example, certain controls may be restricted using lockout devices under normal conditions and are then only available upon unlocking the lockout device by an authorized user. An example of such a lockout device may be a wall switch lockout, in which a cover is lockable over a wall switch in order to prevent non-authorized people from operating the switch. Such wall switch lockouts may be useful for controlling the operation of lighting, for controlling the supply of power to certain appliances or equipment, or for various other switch-type applications.

SUMMARY

As there are a wide range of possible controls and energy isolation points and associated structures, one challenge has been to provide lockout devices that are capable of being used in a wide variety of circumstances and configurations. Put differently, even a lockout device for a control type may need to be offered in a variety of sizes and configurations to accommodate different variations of that control type that may exist. This often leads to similar, but not identical, products having various different stock keeping units or SKUs in which some products are suitable for some use cases, but not all use cases.

For example, in the context of a wall switch lockout, there may be various different mounting arrangements for the lockout device based on the wall switch construction and the placement of the plate screws. This can mean even through an installer has a wall switch lockout on hand, that the particular wall switch lockout might not be appropriate for the particular wall switch construction to be locked out. This can result in end user frustration if the product in hand is not suitable for the task at hand, has the potential to lead to improper or incomplete installation of a lockout device not designed for the particular application, and present inventory management concerns if multiple types of lockouts need to be kept on hand or in stock to accommodate different switch designs.

Disclosed herein is an improved wall switch lockout device. This wall switch lockout device is able to accommodate various mounting arrangements and, in particular, accommodates different hole-to-hole distances for mounting screws as may be exhibited in different switch types (for example, rocker or paddle switches versus toggle switches) where the mounting screw spacing for the front facie or cover may vary based on the mechanical switch type and size. The disclosed construction avoids the need to stock multiple types of wall switch lockout devices for various wall switch types and can offer a more universal-type lockout device.

According to one aspect, a wall switch lockout device is provided for selectively limiting access to a wall switch relative to which the wall switch lockout device is mounted. The wall switch lockout device includes a mountable base having a front face and a rear face and further having a switch opening extending through the base from the front face to the rear face for receiving the wall switch through the opening when the lockout devices is installed over the wall switch. The wall switch lockout device further includes a cover positionable and securable over the front face of the mountable base for selectively covering and limiting access to the switch opening (and, when mounted, the wall switch itself). The device further includes a pair of mounting openings for mounting the mountable base and one or more inserts received in the mountable base and slidable relative to the mountable base. At least one of the pair of mounting openings is on an insert such that, when the insert is slid relative to the mountable base, a hole-to-hole distance between the pair of mounting openings is variably adjusted.

In some forms, there may be a pair of inserts with each of the respective inserts have a corresponding one of the pair of mounting openings on each respective insert. While it is contemplated that the variably adjusting of the hole-to-hole distance might be achieved with one of the mounting openings being fixed relative to the mountable base (i.e., not on a slidable insert) and the other being movable by placing the mounting on a slidable insert, having a pair of inserts instead of a single insert may well be preferable. With a pair of inserts, there may be better symmetry about the opening, improving aesthetics when mounted. Moreover, having a pair of opposing inserts means that each insert could be made to travel half the distance that a single insert would be required to travel to get the same level of hole-to-hole adjustability.

In the instance in which there are a pair of inserts, the pair of inserts may both be slidable towards or away from one another along paths of linear translation that lie along a single line (i.e., the paths lie along a single line, although are spaced along the line). Still further, the pair of inserts and corresponding pair of mounting openings can be positioned on opposing top and bottom sides of the switch opening.

In some forms, the mountable base may include a securement projection extending from the front face thereof with a lock opening in the securement projection and the cover may include a slit through which the securement projection is receivable when the cover is in a closed position such that the lock opening is accessible to receive a lock therethrough to prevent the cover from being moved from the closed position to the opened position.

In some forms, the cover may be hinged to the mountable base. This hinging may be, for example, at a top end of the mountable base.

In some forms, the insert(s) may be slidable relative to the mountable base using a guide and rail connection that slidably connect the insert(s) to the mountable base.

In some forms more specifically, the mountable base may include a base rail and a base guide (corresponding to each insert) and each respective insert may include an insert rail and an insert guide. The insert guide of the respective insert is attachable to the base rail of the mountable base and, likewise, the insert rail is attachable to the insert guide. In such assembly, the insert(s) can be slidable relative to the mountable base along attachments between the insert guide and the base rail and between the base guide and the insert rail. In the case of multiple inserts, the mountable base can have separate rails and guides for each of the inserts. One or both of the insert guide and the base guide may include retaining projections such that the insert guide and the base guide is snappable onto the respective base rail or insert rail to help couple the rail(s) and guide(s) together.

In some forms, the device can further include a pair of detents for maintaining a pair of respective positions of the at least one insert relative to the mountable base. The pair of detents may be projections extending rearwardly from a rear face of the mountable base and can be positioned over a translational path of the at least one insert relative to the mountable base.

In the case where there are a pair of inserts, the pair of respective positions of the inserts establishable using the pair of detents may include (1) a rocker position for mounting the wall switch lockout device to a wall switch having a rocker-type switch with an associated rocker switch hole-to-hole distance and (2) a toggle position for mounting the wall switch lockout device to a wall switch having a toggle-type switch with an associated toggle switch hole-to-hole distance. The rocker switch hole-to-hole distance can be larger than the toggle switch hole-to-hole distance as the mounting spacing of the rocker is larger than that of a toggle switch.

According to another aspect, a method of installing a wall switch lockout device as described above and anywhere herein may include positioning the insert(s) relative to the mountable base to establish the hole-to-hole distance between the pair of mounting openings and then mounting the mountable base using the pair of mounting openings.

These and still other advantages of the invention will be apparent from the detailed description and drawings. What follows is merely a description of some preferred embodiments of the present invention. To assess the full scope of the invention the claims should be looked to as these preferred embodiments are not intended to be the only embodiments within the scope of the claims.

DETAILED DESCRIPTION

Looking first at FIGS. 1 through 4, a wall switch lockout device 10 is illustrated for selectively limiting access to a wall switch (not shown) relative to which the wall switch lockout device 10 is mounted. As illustrated, the wall switch lockout device 10 includes only a small number of components including a mountable base 12, a pair of inserts 14*a* and 14*b*, and a cover 16 which will all be described in turn below in such a manner as to illustrate their connection and usage with one another in order to provide the lockout function for the wall switch.

Figure 2:
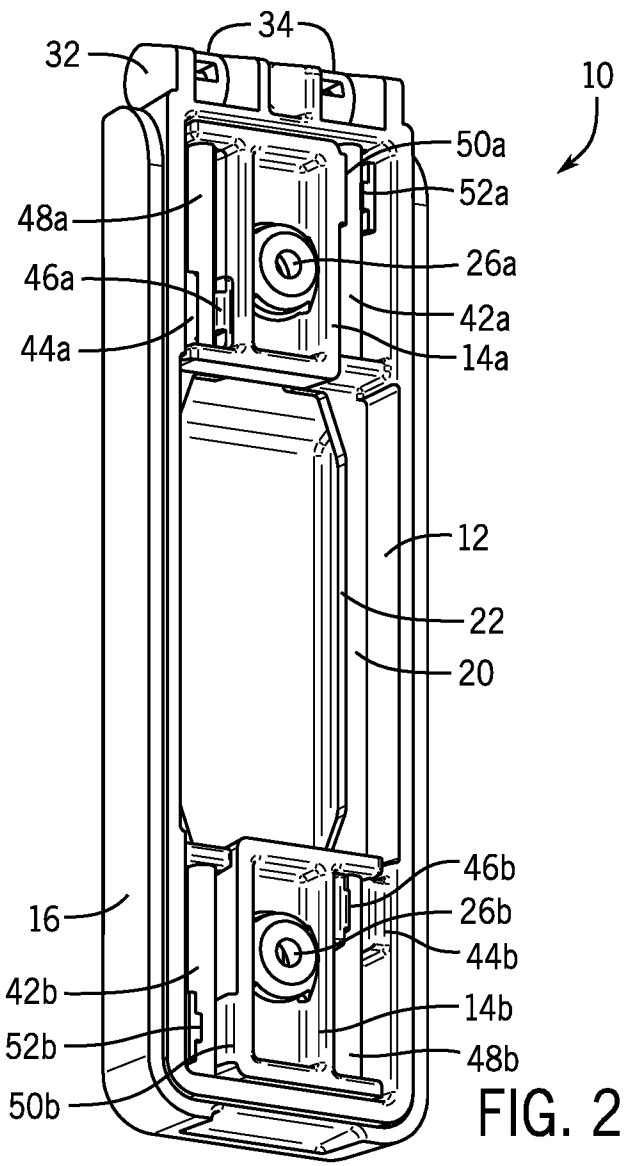
FIG. 2 is rear bottom right side perspective view of the wall switch lockout device in the closed position.
Figure 3:
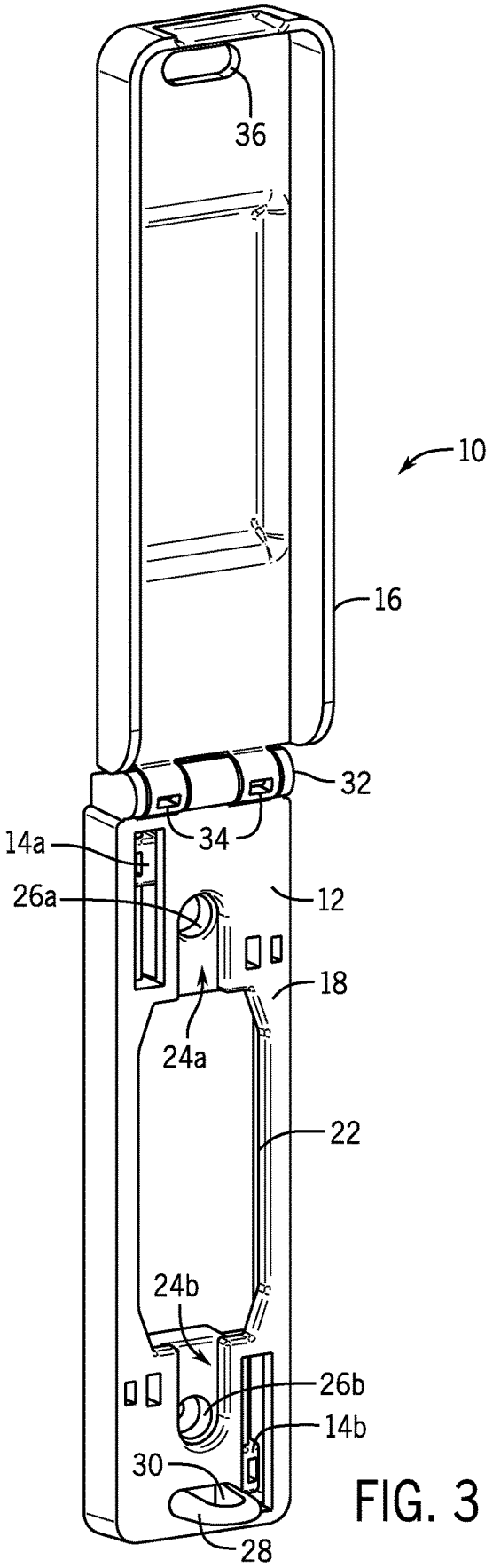
FIG. 3 is front top left side perspective view of the wall switch lockout device similar to FIG. 1 but with the cover in an opened position relative to the mountable base.

With respect to the mountable base 12, the mountable base 12 is perhaps best seen in FIGS. 2 and 3 and is a generally rectangular plate-like body extending in a longitudinal direction having a front face 18 (FIG. 3) and a rear face 20 (FIG. 2). Centrally and extending between this front face 18 and the rear face 20 is a switch opening 22. Since the mountable base 12 is designed to be mounted to various types of wall switches, such as both toggle switches and rocker or paddle switches, the switch opening 22 is sized to permit access to switches that are so geometrically sized and shaped through the switch opening 22. As illustrated, the switch opening 22 also has switch opening extensions 24*a* and 24*b* on the top and bottom of the periphery of the switch opening 22 which are slot-like in form and narrower than the more central part of the switch opening 22 that accommodates the switch after mounting. These switch opening extensions 24*a* and 24*b* are present in order to provide access to the inserts 14*a* and 14*b* that are movable relative to the mountable base 12 and, more specifically, to the pair of mounting openings 26*a* and 26*b* on the inserts 14*a* and 14*b*, respectively, that will be discussed below.

The cover 16 as illustrated is large enough to cover the front face 18 of the mountable base 12 and, moreover in the form shown, has sidewalls that extend around the lateral and lower sides of the periphery of the mountable base 12. This cover 16 also includes a slight bump or protrusion in the in the middle so as to provide some space to accommodate a depth dimension of the switch in the closed position of the cover (that is, space to accommodate, for example, a toggle switch or other forward-facing control which may project forwardly into the space of the cover).

Figure 1:
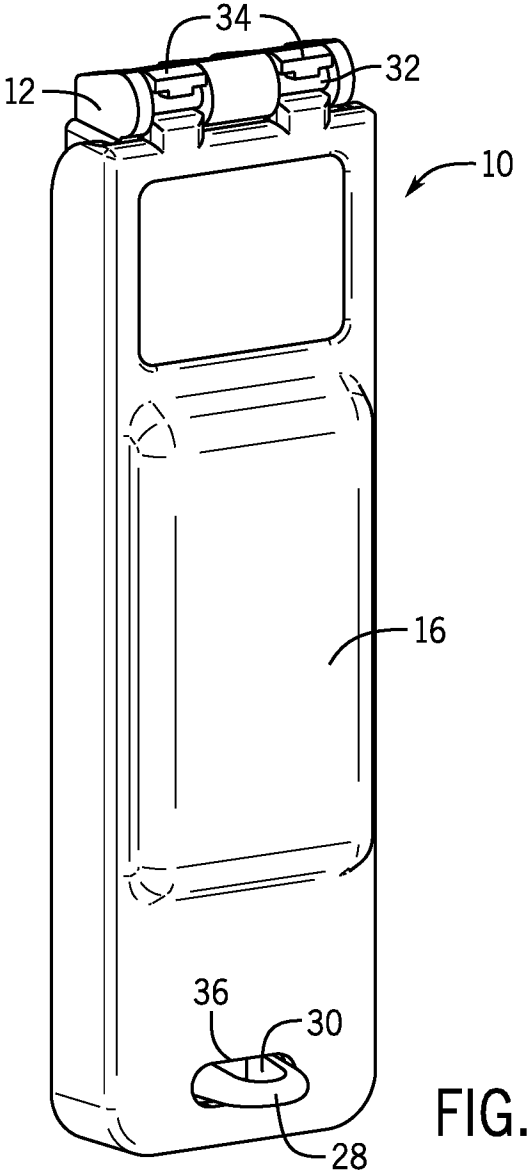
FIG. 1 is front top left side perspective view of a wall switch lockout device in the closed position with the front cover down.
Figure 4:
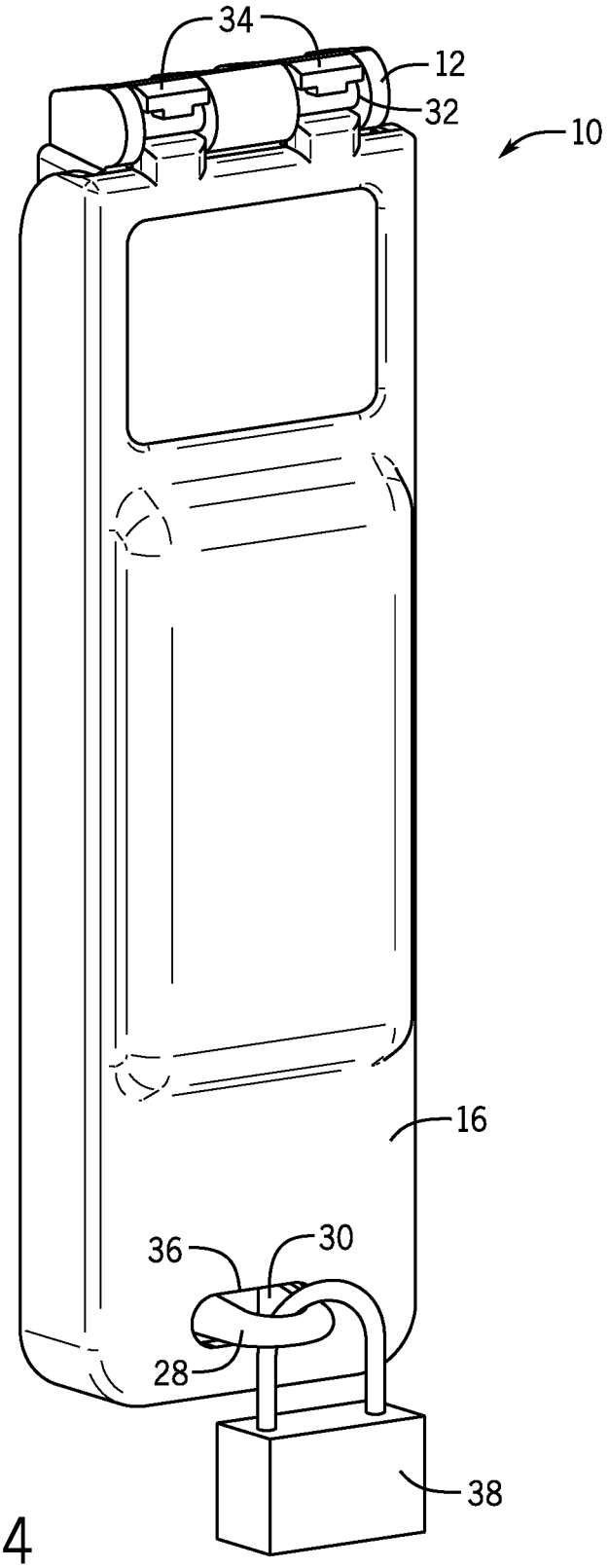
FIG. 4 illustrates the wall switch lockout device in which the cover has been closed relative to the mountable base and a padlock has been attached to secure the cover in the closed position.

For the purposes of providing lockout functionality, on the front face 18 of the mountable base 12 and as best seen in FIGS. 3 and 4, there is securement projection 28 extending from the front face 18 which provides a closed loop that includes a lock opening 30 therein. There is also, at the top end of the mountable base 12, a hinge part 32 that is adapted for connection to a mating hinge part 34 on the cover 16 to collectively provide a hinged connection between the mountable base 12 and the cover 16. In the particular design illustrated, the hinge part 32 on the base 12 is a hinge rod and the hinge part 34 is a pair of snap on retaining fingers or guides. This hinged connection lets the cover 16 be movable and positionable between an opened position as shown in FIG. 3 and a closed position, as illustrated in FIGS. 1, 2, and 4.

In the opened position of the cover 16 relative to the mountable base 12 as illustrated in FIG. 3, the cover 16 is lifted to provide access to the switch opening 22 on the front face 18 of the mountable base 12 and, more meaningfully, the wall switch that would be accessible at the switch opening 22 when the device 10 is mounted.

In the closed position of the cover 16 relative to the front face 18 of the mountable base 12 as depicted in FIG. 4, the cover 16 covers and limits access to the switch opening 22 and the switch. Moreover, in this closed position, the securement projection 28 is received through a slot 36 formed in the cover 16 at a lower end of the cover 16. In order to secure or temporarily lock the cover 16 in this closed position, a padlock 38 or other securing mechanism can be received through the lock opening 30 in the securement projection 28 as is illustrated in FIG. 4. With the padlock 38 in place (or some other variety of lock), the cover 16 cannot be moved relative to the base 12 to expose the switch opening 22 or switch and so the switch to which the device 10 is mounted cannot be operated.

While various hinge designs might be implemented with similar results, with the pin and snap on guide arrangement illustrated in the exemplary embodiment, and more particularly in FIG. 4, the orientation of the guides or fingers can be designed such that the hinge at the top cannot be decoupled in the closed position. That is to say, the parts that are snapped onto the hinge rod, in the closed position, can be C-shaped with the open end of the snap part C-shape facing forward such that the hinge parts cannot be decoupled when the device 10 is in the closed position.

It will be appreciated that while a hinged arrangement between the cover and the mountable base are shown, that the cover need not necessarily be hinged. For example, the cover could be slidable relative to the base providing enough clearance for any switch control. Still further, while a securement projection 28 and slot 36 are shown, other cover locking arrangements could be workable including alignable holes and so forth which may be at least in part based on the range of motion of the cover. So while the exemplary lockout device 10 is illustrative, it should not be considered limiting.

Turning now to the pair of inserts 14*a* and 14*b*, the pair of inserts 14*a* and 14*b* are received in the mountable base 12 and are slidable relative to the mountable base 12. Each of the inserts 14*a* and 14*b* have a respective one of the mounting openings 26*a* and 26*b* centrally located thereon, and so these openings 26*a* and 26*b* travel with the respective inserts 14*a* and 14*b*. Further and as illustrated, there is one insert 14*a* positioned at the top end of the switch opening 22 and another insert 14*b* positioned at the opposing bottom end of the switch opening. In the form show, the insert 14*a* is proximate the top switch opening extension 24*a* while the insert 14*b* is proximate the bottom switch opening extension 24*b*.

Figure 5:
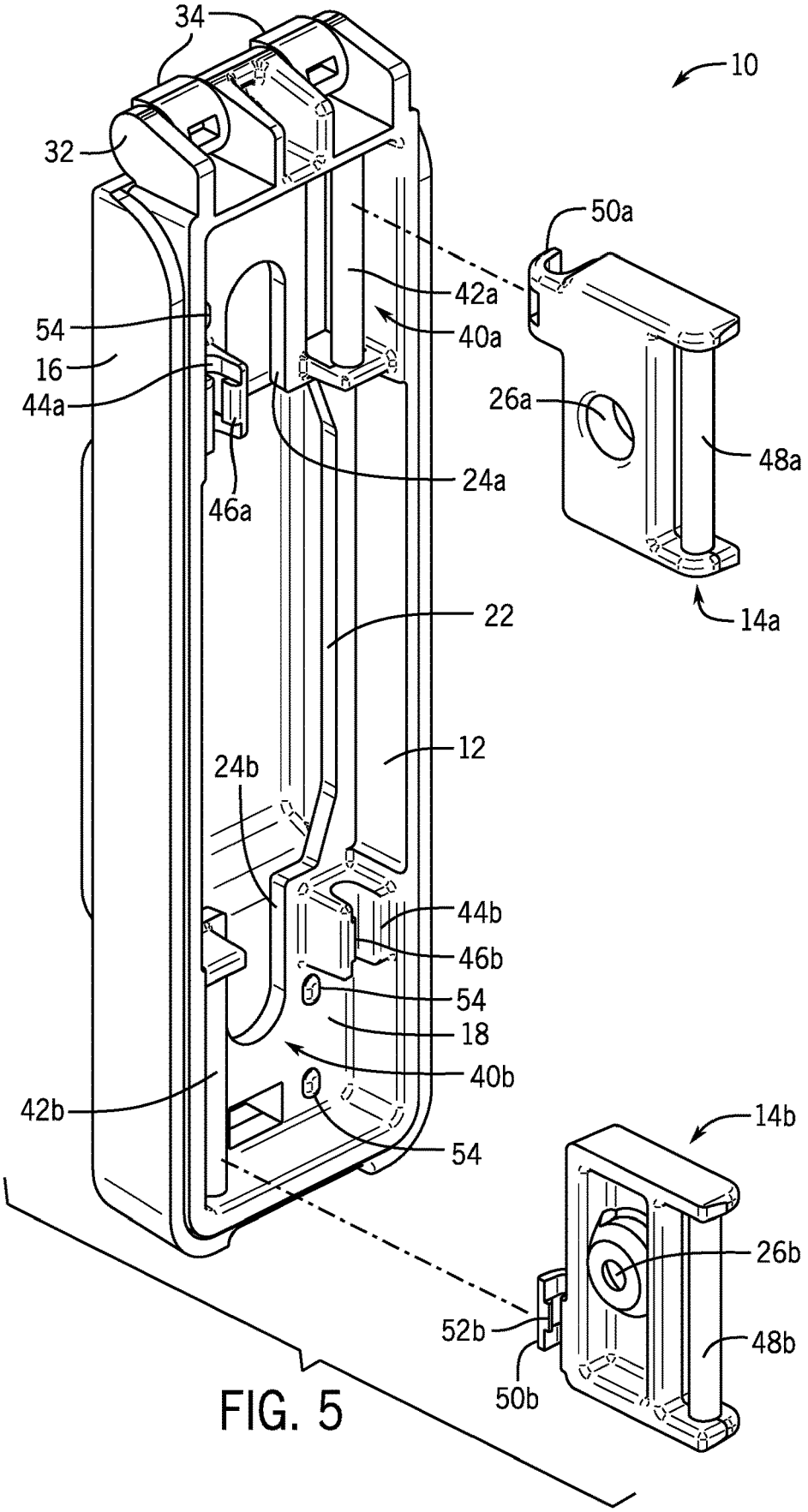
FIG. 5 is an exploded rear side perspective view of the cover showing the pair of inserts exploded from the mountable base.

The mounting and sliding structure for the inserts 14*a* and 14*b* in the mountable base 12 can be best seen in FIG. 5 in which the inserts 14*a* and 14*b* are exploded from the mountable base 12. It is there seen that the rear face 20 of the mountable base 12 includes a pair of insert-receiving structures 40*a* and 40*b* each including a respective base rail 42*a* or 42*b* and a respective base guide 44*a* or 44*b* having retaining projections 46*a* or 46*b*. Likewise, each of the inserts 14*a* and 14*b* each include a respective insert rail 48*a* or 48*b* and a respective insert guide 50*a* or 50*b* having retaining projections 52*a* or 52*b*. Relative to the orientation illustrated in the figures, the various rails and guides on each of the base 12 and inserts 14*a* and 14*b* are, generally speaking, on lateral sides of the respective structures with the rails extending in the top to bottom or longitudinal direction and guides being so configured as to be snapped to the rails in an orientation as to permit the travel of the inserts 14*a* and 14*b* in the top to bottom direction (and vise-versa) relative to the mountable base 12.

Figure 6:
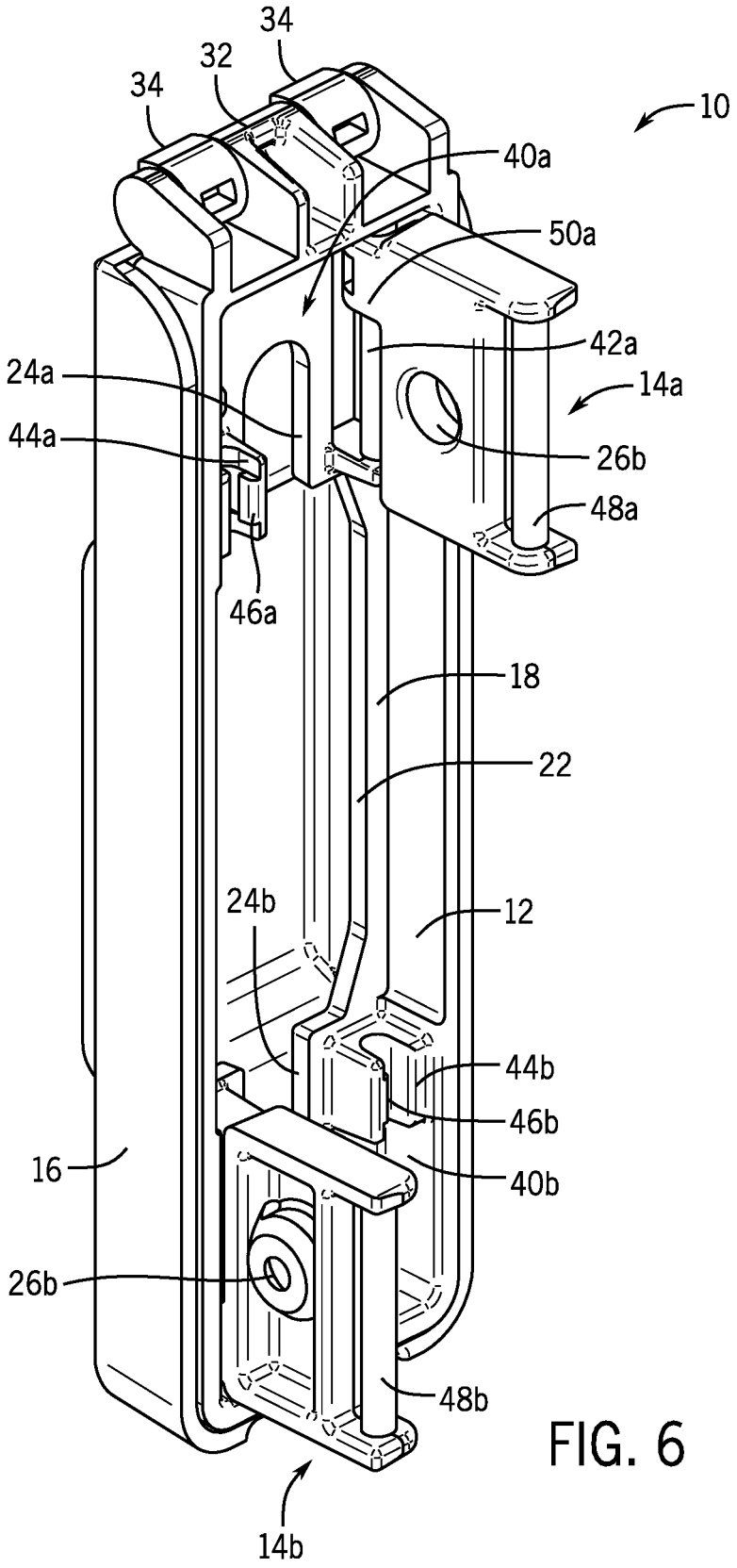
FIG. 6 is a detailed perspective view illustrating a first step of installation in which a guide from one of the inserts is snapped onto a rail on one side of the mountable base.
Figure 7:
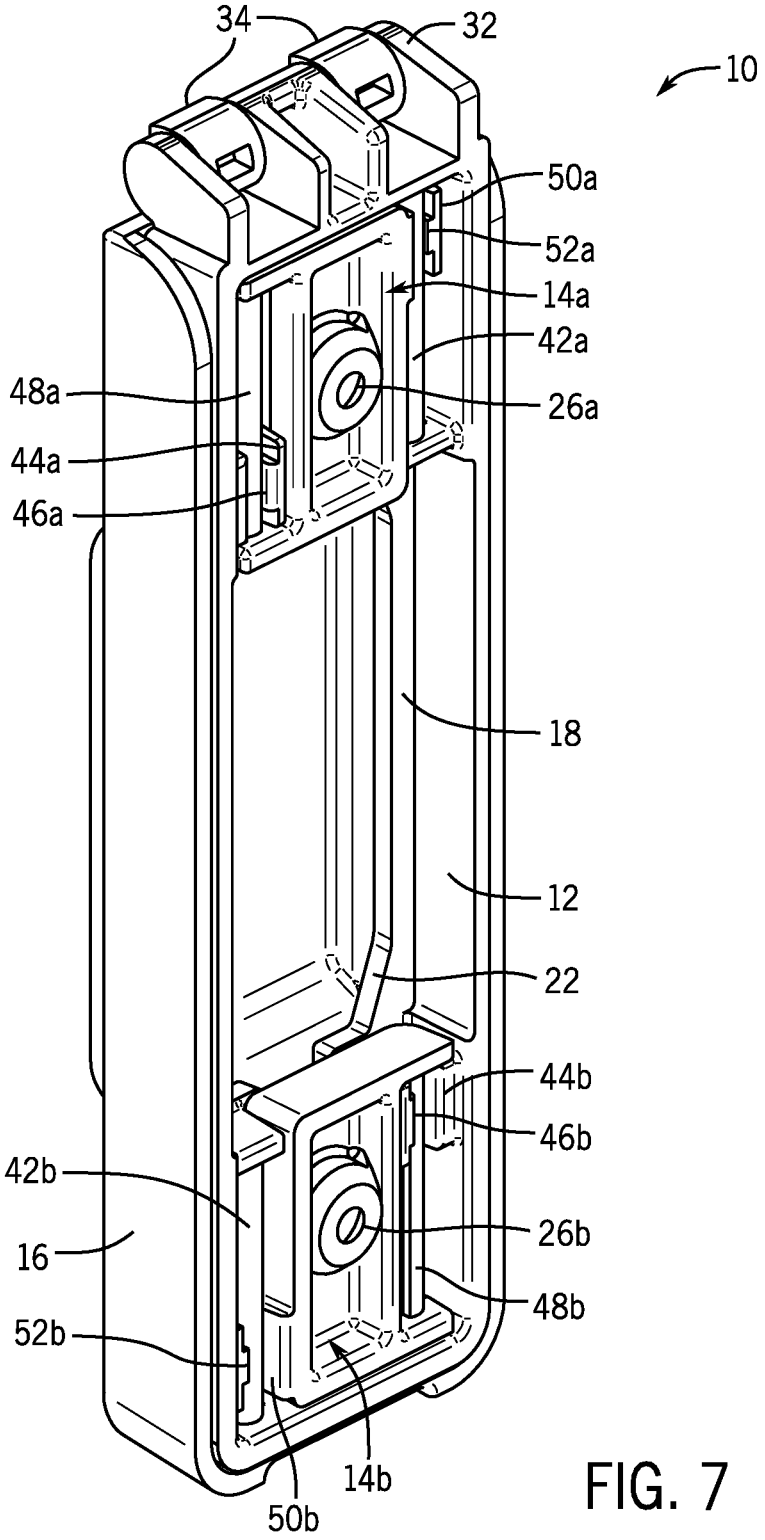
FIG. 7 is a detailed perspective view illustrating a second step of installation from FIG. 6 in which the insert is further swung, such that the rail on the insert is snapped into a guide in the mountable base.

Turning now to FIGS. 6 and 7, the installation of the respective inserts 14*a* and 14*b* into the mountable base 12 is shown as a two-step process. First, the insert guides 50*a* and 50*b* are received onto the base rails 42*a* and 42*b* of the mountable base 12. Looking at both FIGS. 5 and 6, the insert guides 50*a* and 50*b* are C-shaped with laterally outward facing recesses with retaining projections 52*a* or 52*b* that are snapped onto the respective base rails 42*a* and 42*b*.

As illustrated in FIG. 7, after the insert guides 50*a* and 50*b* are snapped onto the respective base rails 42*a* and 42*b*, the other side of the respective inserts 14*a* and 14*b* supporting the insert rails 48*a* and 48*b* are rotated about the hinge created by the insert guides 50*a* and 50*b* and their respective base rails 42*a* and 42*b*, such that the insert rails 48*a* and 48*b* are received into the base guides 44*a* or 44*b*. Just as with the first connection between the insert guides 50*a* and 50*b* and the respective base rails 42*a* and 42*b*, the connection formed between the base guides 44*a* or 44*b* and the insert rails 48*a* and 48*b* can be a snap fit with the retaining projections 46*a* or 46*b* being somewhat flexible to permit them to be connected with a little pressure during coupling and to keep the features together once connected.

Figure 9:
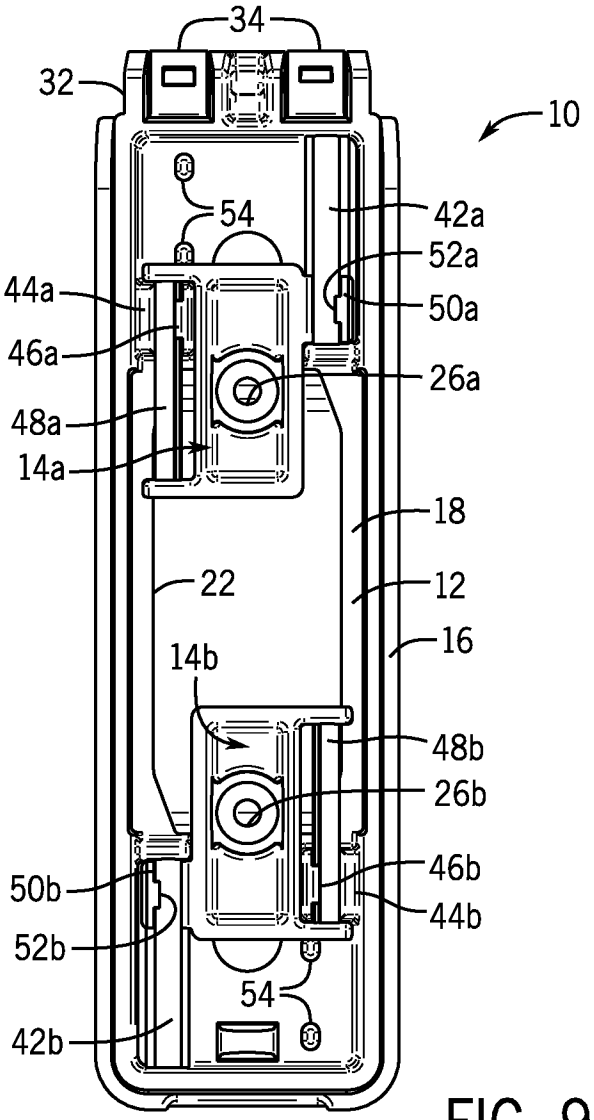
FIG. 9 is a rear plan view of the wall switch lockout device in which the pair of inserts are slid toward one another to minimize the hole-to-hole distance between the inserts.
Figure 8:
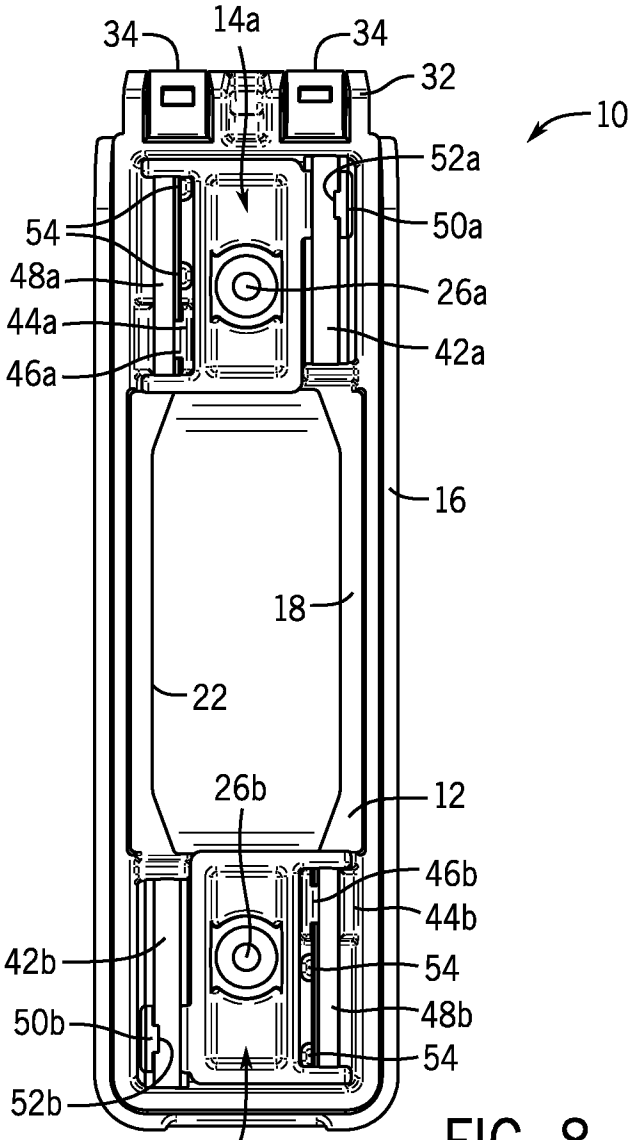
FIG. 8 is a rear plan view of the wall switch lockout device in which the pair of inserts are slid away from one another to maximize the hole-to-hole distance between the inserts.

With this structure, the inserts 14*a* and 14*b* are able to slide and translated top to bottom along the travel line established between various respective guides and rails of the mountable base 12 and the inserts 14*a* and 14*b*. As shown in FIGS. 8 and 9, this permits the inserts 14*a* and 14*b* to be spaced a maximum distance from one another to create a large hole-to-hole distance between the pair of mounting openings 26*a* and 26*b* (such as to match the mounting plate screw distance of a rocker or paddle switch) and permits the inserts 14*a* and 14*b* to be brought together to be spaced a minimum distance from one another to create a small hole-to-hole distance between the pair of mounting openings 26*a* and 26*b* (such as to match the mounting plate screw distance of a toggle switch).

As illustrated, the inserts 14*a* and 14*b* each can travel over a path of linear translation on opposing sides of the switch opening 22 to accommodate for various mounting arrangements and hole-to-hole distances. These respective pair of paths of linear translation can lie along a single line with the center of the mounting openings 26*a* and 26*b* traveling along this single line as the inserts 14*a* and 14*b* move. As illustrated, in all positions of the inserts 14*a* and 14*b* relative to the mountable base 12, the mounting openings 26*a* and 26*b* are positioned somewhere along the switch opening extensions 24*a* and 24*b* or moved into the more central part of the switch opening 22 such that the mounting openings 26*a* and 26*b* could receive a mounting screw therethrough for mounting at the faceplate screws openings associated with the switch.

While it is contemplated that the inserts 14*a* and 14*b* might be positioned anywhere along their path of travel, it is also contemplated that detents 54 can be used to establish discrete positions of the inserts 14*a* and 14*b* relative to the mountable base 12. In the embodiment illustrated, these detents 54 can be best seen in FIGS. 5 and 9 on the rear face 18 of the mountable base 12. These detents 54 can be small projections that extend from the rear face 18 and a respective feature of the inserts 14*a* or 14*b* (such as a wall or lip) to maintain the a respective insert 14*a* or 14*b* at a specific position relative to the mountable base 12. This can perhaps be best seen in FIG. 8, in which the uppermost and lowermost detents 54 engage a lower side of an uppermost wall of the insert 14*a* or an upper side of a lowermost wall of the insert 14*b*, respectively, to maintain the inserts 14*a* and 14*b* at a maximum permitted distance from one another and establishes the rocker switch position with maximum hole-to-hole distance. This can also be seen in FIG. 9, in which the more centrally located detents 54 engage an upper side of an uppermost wall of the insert 14*a* or lower side of a lowermost wall of the insert 14*b*, respectively, to maintain the inserts 14*a* and 14*b* at a minimum permitted distance from one another and establishes the toggle switch position with minimum hole-to-hole distance. While two discrete positions are illustrated to accommodate a rocker and a toggle position, it will be appreciated that there could be a number of detents provided beyond the four detents that provide two positions for each insert. Still further, there could be no detents and/or there could be a variable range of positions available between the two spacing extreme for any non-standard mounting screw spacings. Even beyond this, it will be appreciated that other forms of detents could be utilized that are different from those specifically illustrated; for example, the detents could be found on the insert and interface with features on the rear face of the mountable base.

Finally, it should be appreciated that while a wall switch lockout device has been illustrated having a pair of inserts that are both slidable and positionable relative to a mountable base, it is contemplated that similar functionality might be achievable with only a single insert having a movable mounting opening on one side of the switch opening and one or two fixed mounting openings formed in the mountable base on the other side of the switch opening. However, as can be seen from FIG. 9 illustrating the toggle position, the mounting openings on the inserts tend to extend into the central space of the switch opening. Practically speaking, this extension into the central space may preclude certain configurations with a single insert and so a pair of opposing inserts may be required for some mounting arrangements and adjustability; however, depending on the range of adjustment desired, it may be possible to provide only a single sliding insert instead of a pair of inserts. It should be appreciated however, that such one-sided insert design might result in an off-center mounting arrangement or less aesthetically pleasing appearance upon mounting. Still further, it is contemplated that such lockouts might also be modified and designed for multi-gang switch arrangements and that there could be more than a pair of inserts, so as to provide for mounting at each of the various faceplate mounting openings (of which there might be 2, 4, 6, and so on, each of which set have a corresponding set of inserts).

In use, once the wall switch lockout device 10 is assembled (and it is certainly contemplated that the device 10 could be sold as a pre-assembled product), the inserts 14*a* and 14*b* may be slid relative to the mountable base 12 to the desired position to provide the target hole-to-hole spacing for the particular switch installation. The mountable base 12 can then be secured to the underlying switch using the openings on the switch that are used to secure the faceplate to the front of the switch—and the faceplate also can be captured between the lockout device 10 and the switch—such that the switch control extends through the switch opening 22 in the mountable base 12. Once the mounting screws are secured in place, then the cover 16 can be moved between the opened and closed positions to provide access to or to restrict access to the switch. In the closed position, and as described above, to lock out the switch and make it inoperable, a padlock or other securement device can be used to lock the cover 16 in the closed position as illustrated in FIG. 4. Since the mounting screws are only accessible when the device 10 is open, the device 10 cannot be removed so long as the cover 16 is in the closed and locked position relative to the mountable body 12. Then, only after the padlock or securement device has been removed, can the cover 16 be opened.

As noted above, it should be appreciated that various other modifications and variations to the preferred embodiments can be made within the spirit and scope of the invention. Therefore, the invention should not be limited to the described embodiments. To ascertain the full scope of the invention, the following claims should be referenced.

What is claimed is:

1. A wall switch lockout device for selectively limiting access to a wall switch relative to which the wall switch lockout device is mounted, the wall switch lockout device comprising:

a mountable base having a front face and a rear face, the mountable base having a switch opening extending therethrough from the front face to the rear face for receiving the wall switch therethrough;

a cover positionable and securable over the front face of the mountable base for selectively covering and limiting access to the switch opening;

a pair of mounting openings for mounting the mountable base in which the pair of mounting openings extend in a direction perpendicular to a front face of the mountable base; and at least one insert received in the mountable base and slidable relative thereto;

wherein at least one of the pair of mounting openings is on the at least one insert such that, when the at least one insert is slid relative to the mountable base, a hole-to-hole distance between the pair of mounting openings is variably adjusted.

2. The wall switch lockout device of claim 1, wherein the one or more inserts are a pair of inserts with each of the respective inserts have a corresponding one of the pair of mounting openings thereon.

3. The wall switch lockout device of claim 2, wherein the pair of inserts are both slidable towards or away from one another along paths of linear translation that lie along a single line.

4. The wall switch lockout device of claim 2, wherein the pair of inserts and corresponding pair of mounting openings are on opposing top and bottom sides of the switch opening.

5. The wall switch lockout device of claim 1:

wherein the mountable base includes a securement projection extending from the front face thereof with a lock opening therein;

wherein the cover includes a slit through which the securement projection is receivable when the cover is in a closed position, such that the lock opening is accessible to receive a lock therethrough to prevent the cover from being moved from the closed position to the opened position.

6. The wall switch lockout device of claim 1, wherein the cover is hinged to the mountable base.

7. The wall switch lockout device of claim 6, wherein the cover is hinged to the mountable base at a top end thereof.

8. A wall switch lockout device for selectively limiting access to a wall switch relative to which the wall switch lockout device is mounted, the wall switch lockout device comprising:

a mountable base having a front face and a rear face, the mountable base having a switch opening extending therethrough from the front face to the rear face for receiving the wall switch therethrough, wherein the mountable base includes a base rail and a base guide;

a cover positionable and securable over the front face of the mountable base for selectively covering and limiting access to the switch opening;

a pair of mounting openings for mounting the mountable base; and at least one insert received in the mountable base and slidable relative thereto, wherein the at least one insert includes an insert rail and an insert guide;

wherein at least one of the pair of mounting openings is on the at least one insert such that, when the at least one insert is slid relative to the mountable base, a hole-to-hole distance between the pair of mounting openings is variably adjusted; and wherein the insert guide of the at least one insert is attachable to the base rail of the mountable base and the insert rail is attachable to the insert guide such that the insert is slidable relative to the mountable base along attachments between the insert guide and the base rail and between the base guide and the insert rail.

9. The wall switch lockout device of claim 8, wherein one or both of the insert guide and the base guide include retaining projections such that the insert guide and the base guide is snappable onto the respective base rail or insert rail.

10. The wall switch lockout device of claim 8, further comprising a pair of detents for maintaining a pair of respective positions of the at least one insert relative to the mountable base.

11. The wall switch lockout device of claim 10, wherein the pair of detents are projections extending rearwardly from a rear face of the mountable base and are positioned over a translational path of the at least one insert relative to the mountable base.

12. The wall switch lockout device of claim 10, wherein there are a pair of inserts and wherein the pair of respective positions of the inserts establishable using the pair of detents include:

a rocker position for mounting the wall switch lockout device to a wall switch having a rocker-type switch with an associated rocker switch hole-to-hole distance; and a toggle position for mounting the wall switch lockout device to a wall switch having a toggle-type switch with an associated toggle switch hole-to-hole distance;

wherein the rocker switch hole-to-hole distance is larger than the toggle switch hole-to-hole distance.

13. The wall switch lockout device of claim 1, wherein the at least one insert is slidable relative to the mountable base using a guide and rail connection that slidably connect the at least one insert to the mountable base.

14. A method of installing the wall switch lockout device of claim 1 comprising:

positioning the at least one insert relative to the mountable base to establish the hole-to-hole distance between the pair of mounting openings; and mounting the mountable base using the pair of mounting openings.

15. The method of claim 14, wherein the step of mounting the mountable base involves mounting the mountable base to a wall switch by receiving mounting screws through the pair of mounting openings.

16. The wall switch lockout device of claim 1, wherein the pair of mounting openings are configured for receiving mounting screws therethrough for mounting the wall switch lockout device to the wall switch.

* * * * *